United States Patent [19]

Dollison

[11] Patent Number: 4,491,055

[45] Date of Patent: Jan. 1, 1985

[54] CONTROL OF CONTINUOUS RECIPROCATION OF A FLUID POWER CYLINDER

[75] Inventor: William W. Dollison, Dallas, Tex.

[73] Assignee: Otis Engineering Corporation, Dallas, Tex.

[21] Appl. No.: 317,429

[22] Filed: Nov. 2, 1981

[51] Int. Cl.[3] ..... F01L 31/02

[52] U.S. Cl. ..... 91/306; 91/308; 91/311; 60/381; 137/624.15

[58] Field of Search ..... 60/382, 381, 369; 91/305, 306, 337, 39, 40, 191, 193, 194, 308, 311; 137/624.15

[56] References Cited

U.S. PATENT DOCUMENTS

| | | | |
|---|---|---|---|
| 2,437,115 | 3/1948 | Muller et al. | 60/382 |
| 3,324,770 | 6/1967 | Dahlman et al. | 91/40 |
| 3,620,126 | 11/1971 | Fuhrimann | 91/306 |
| 3,735,669 | 5/1973 | Henke et al. | 91/306 |
| 3,916,768 | 11/1975 | Martin | 91/40 |

*Primary Examiner*—Robert E. Garrett

*Assistant Examiner*—Richard S. Meyer

*Attorney, Agent, or Firm*—H. Mathews Garland

[57] ABSTRACT

The pump or pumps for supplying fluid to the two ends of a double-acting cylinder include a direction control, such as a direction control valve, shiftable between extend and retract conditions. A drive mechanism for the direction control includes a rotary hydraulic motor and a driven rotary drive mechanism for shifting the direction control. Hydraulic fluid is supplied to the drive motor through parallel connected start and stop valves. The start valve is opened in response to the movements of the hydraulic cylinder toward a stroke limit. The stop valve is operated in response to the shifting of the direction control, so that the motor is operated intermittently to reverse the direction control when the cylinder reaches the limit of an extend or retract stroke. The stop valve is controlled by the drive mechanism in timed relation with the shifting of the direction control. The start valve may be closed by that drive mechanism in timed relation with the opening of the stop valve.

13 Claims, 5 Drawing Figures

CONTROL OF CONTINUOUS RECIPROCATION OF A FLUID POWER CYLINDER

This invention relates to a system and method for controlling the continuous reciprocation of a double-acting fluid power cylinder; and more particularly to such system and method which utilizes a completely fluid logic control. Such a power cylinder may be used, for example, in the hydraulic rod pumping of oil wells or as the power end of a fluid-to-fluid high pressure hydraulic pump.

An object of this invention is to provide an improved system and method for controlling the continuous reciprocation of a fluid power cylinder.

Another object of this invention is to provide such improved system and method including precise control of the acceleration and deceleration of the piston at the stroke extremities.

A further object of this invention is to provide such improved system and method including a completely fluid logic circuit.

Still another object of this invention is to provide such improved system and method allowing full control of cylinder movements.

A system for accomplishing these objects includes the following components. A fluid supplying means for supplying pressurized fluid alternately to the cylinder ends, to extend and retract the cylinder, includes a direction control shiftable between extend and retract conditions. Drive means for that direction control includes a fluid motor. A supply means supplies pressurized motive fluid to the fluid motor. The flow of motive fluid to the motor is controlled by first and second parallel connected valves. Operator means for controlling the opening of the first valve are responsive to the extend and retract movements of the power cylinder. Operator means for controlling the opening and closing of the second valve are responsive to the shifting of the direction control of the fluid supplying means for the cylinder.

A method for accomplishing these objects includes the following steps. Pressurized fluid is supplied alternately to the opposing ends of the cylinder, by means having a direction control shiftable between extend and retract conditions. The direction control is shifted by means of a fluid motor and a coupled drive means. Motive fluid is supplied to the fluid motor through first and second parallel connected valves. The first control valve is controlled in response to the extend and retract movements of the power cylinder. The second control valve is controlled in response to the shifting of the direction control of the fluid supplying means.

The novel features and the advantages of the invention, as well as additional objects thereof, will be understood more fully from the following description when read in connection with the accompanying drawing.

DRAWING

DESCRIPTION OF THE PREFERRED EMBODIMENTS

While the drawings and following description refer to the invention as embodied in a hydraulic system, it will be understood that the invention relates as well to other systems such as a compressed air system.

Figure 1A:
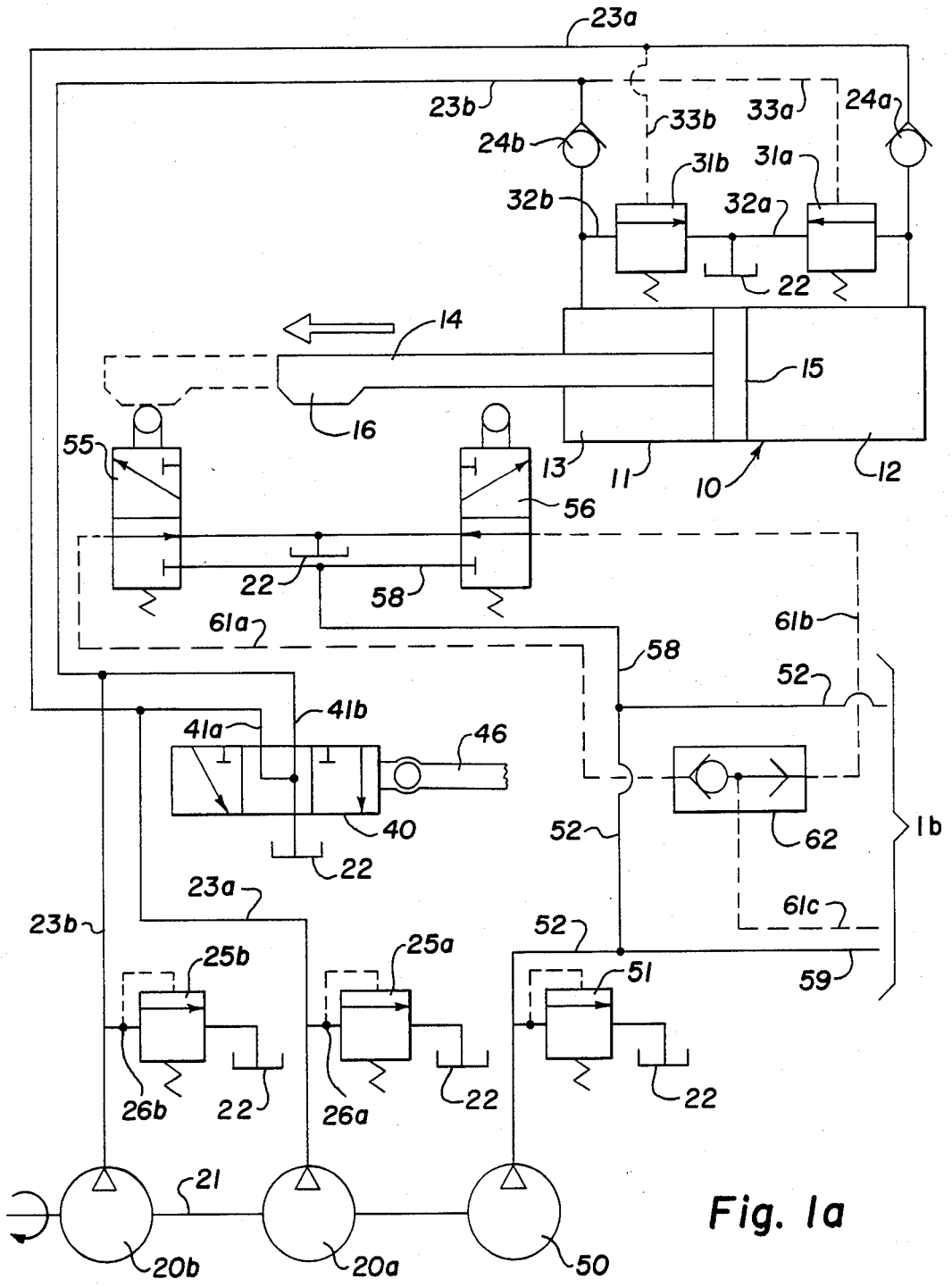
FIGS. 1A and 1B are a schematic diagram of a double-acting power cylinder and an associated control system embodying the invention.
Figure 1B:
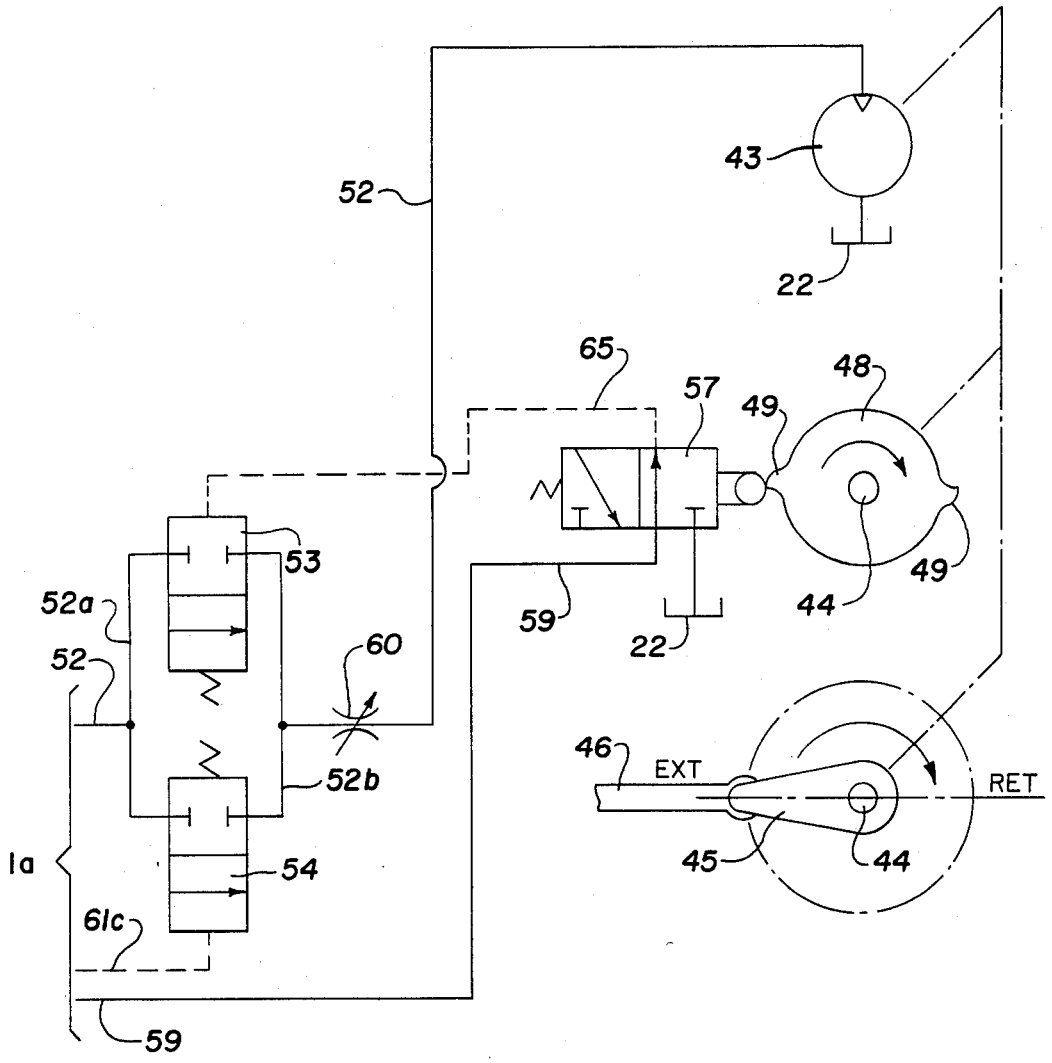

FIGS. 1A and 1B illustrate schematically a double-acting hydraulic cylinder having a cap end and a rod end, and a complete hydraulic control system for controlling the reciprocation of that cylinder. The power portion of the control circuit, for effecting the reciprocation of the cylinder, is the subject of applicant's co-pending application entitled HYDRAULIC CYLINDER AND CONTROL, Ser. No. 303,724, filed Sept. 21, 1981. While the illustrated cylinder is a single large rod hydraulic cylinder, it will be understood that the control system may be used as well with other types of double-acting hydraulic cylinder apparatus.

The illustrated hydraulic cylinder 10 includes an elongated tubular housing 11 having a cap end 12 and a rod end 13, with a rod 14 extending through the rod end in sealing relation and having a piston 15 fixed thereto at its inner end. It will be understood that this cylinder configuration is by way of example only, with the references to "cap end" and "rod end" providing convenient identification of the opposite ends of a power cylinder 10. Similarly the references to "extension" and "retraction" of the piston rod provide convenient identification of the opposite movements of the cylinder and piston rod.

The hydraulic power circuit might be referred to as a parallel circuit, that is having parallel fluid paths for flowing fluid from the supply reservoir to the respective cylinder ends; and these paths including substantially identical components. In the following description, the fluid flow path and components for the cap end will be identified by reference numbers including the subscript a; and the flow path and components for the rod end will be identified by reference numbers including the subscript b.

The power circuit includes two fixed volume pumps **20*a* and 20*b* each selected to have the desired parameters with respect to volume and pressure to enable it to perform its desired function. As seen in the drawing, the pump 20*a* is associated with the cap end of the cylinder 10, while the pump 20*b* is associated with the rod end of the cylinder. As illustrated in the drawing, the two pumps are coupled to be driven by a common drive shaft 21 and a single power source (not shown); however, if desired, the pumps could have independent drives. A hydraulic fluid reservoir or tank 22** provides the source of hydraulic fluid for both pumps; and this tank is indicated schematically with respect to several returns of the system.

Referring now to the portion of the circuit for supplying fluid to the cylinder cap end 12, the outlet of the pump **20*a* is connected to the cap end by a fluid line 23*a* which includes a check valve 24*a* allowing flow only in the direction toward the cylinder. A pressure relief valve 25*a* is connected in a line 26*a* branching from the line 23*a* and dumping to the tank 22. This relief valve responds to the pressure in the line 23*a*** and will open to dump fluid to the tank when the maximum selected pressure for that line is achieved. This valve then limits the maximum fluid pressure available to the cap end of the cylinder.

The portion of the system for supplying fluid to the rod end 13 of the cylinder includes substantially identical components, namely the pump 20*b* coupled to the rod end by the line 23*b* and check valve 24*b*. Since the effective piston area of the piston rod assembly in the rod end of the cylinder is quite different from that of the cap end, the parameters of the pump 20*b* may be quite different from those of pump 20*a*. This system is also provided with a pressure relief valve 25*b* for dumping fluid through the line 26*b* to tank at a selected maximum pressure; and the selected maximum pressure for the valve 25*b* will likely be different from that for the valve 25*a*.

The control system includes sequence valves 31*a* and 31*b* associated respectively with the cap end and rod end of the cylinder 10. These sequence valves are connected as crosspiloted sequence valves to prevent the cylinder rod from "overrunning" in the event that the resistance to movement of the rod should reverse for some reason. In the schematic drawing, the sequence valve 31*a* is connected between the line 23*a* and the tank 22 by a line 32*a;* and, similarly, the valve 31*b* is connected between the line 23*b* and the tank by a line 32*b*. It will be understood that these sequence valves may be mounted directly on the cylinder 10 so that there may be no rupturable flexible fluid line between the valve and the cylinder, for example. The sequence valve 31*a* for the cap end is connected to the line 23*b* for the rod end by a pilot line 33*a;* and accordingly this valve is opened in response to the pressure in the rod end. Correspondingly the sequence valve 31*b* associated with the rod end is connected to the line 23*a* by a pilot line 33*b;* and this valve responds to the pressure in the cap end. The opening pressures for the sequence valves are selected as desired. In the operation of these sequence valves, when it is desired to move the rod 14 to the left for example, the pressure will build up in the cap end, but the rod and piston cannot move until the pressure of fluid in the rod end is released. This release occurs when the pressure in the cap end reaches a selected value to effect the opening of the sequence valve 31*b* and allow the fluid from the rod end to dump to tank through the line 32*b*. The operation is similar for moving the rod in the opposite direction; however the release pressure for the valve 31*a* may be different from that selected for the valve 31*b*.

The directional control of the rod 14 is accomplished by means of a direction control valve 40 connected between the outlets of the two pumps 20*a* and 20*b* and the tank 22. While the valve 40 is depicted in the drawing as a spool type valve, it may be of any suitable design such as a plug valve, shear seal valve, double poppet valve, or rotary valve. The direction control valve 40 is a three-position valve having an intermediate dump position in which the outlets of both pumps are communicated with the tank 22 so that both pumps are effectively "unloaded." The valve has extend and retract positions for effecting the flow of fluid from a respective pump to its respective cylinder end.

Referring to the control for the cap end, the outlet of the pump 20*a* is connected to the valve 40 by means of a line 41*a;* and with the valve in the dump position the outlet of the pump 20*a* is dumped to tank. Similarly the outlet of the pump 20*b* is connected to the valve 40 by a line 41*b;* and in the dump position of the valve the outlet of the pump 20*b* is dumped to tank. To extend the rod 14 (to the left in the drawing) the control valve 40 is shifted to the left (in the drawing) wherein the line 41*a* is blocked at the valve, but the line 41*b* remains open and continues to dump fluid from the pump 20*b* to the tank. With the line 41*a* blocked, the output from the pump 20*a* necessarily flows through the line 23*a* to the cap end of the cylinder to extend the rod. Similarly, to retract the rod, the valve 40 is shifted to the right to block the line 41*b,* while the line 41*a* is open to tank. Fluid from the pump 20*b* then flows to the rod end of the cylinder 10.

It will be seen that the acceleration or deceleration of the piston and cylinder rod assembly will be directly related to the manner in which the direction control valve 40 is shifted. With appropriate manipulation of the direction control valve, it is possible to cause the cylinder rod 14 to emulate simple harmonic action in the pattern of acceleration and deceleration it experiences. For both directions of movement of the rod, the speed of movement will be proportional to the discharge rate of the respective pump, and the maximum force applied to the piston will be limited by the setting of the respective pressure relief valve.

The operation of the power circuit of the control system is believed apparent from the foregoing description. Obviously the system is designed for continuous drive of the two pumps 20*a* and 20*b*.

To control the reciprocation of the cylinder 10, a mechanism is provided to reciprocate the direction control valve 40. This echanism includes a small rotary hydraulic motor 43 having an output shaft 44, with a crank arm 45 non-rotatably fixed to the output shaft. A pitman arm or link 46 is connected between the crank arm and the reciprocating spool of the illustrated spool type control valve. It will be understood that for this or other types of direction control valves other suitable echanism may be coupled to the output shaft of the motor to provide the desired shifting of the direction control valve.

A rotary cam 48 having diametrically opposite external lobes 49 is also nonrotatably fixed to the motor shaft 44, for a purpose to be described subsequently.

A low pressure hydraulic pump 50 and associated relief valve 51 provides pressurized fluid for driving the hydraulic motor 43, and also provides pilot fluid for operating certain pilot operated valves which are a part of the hydraulic logic circuit and system now to be described. If desired, the pump 50 may be driven by the drive shaft 21 driving the pumps 20*a* and 20*b*. The pressurized fluid from the pump 50 to the motor 43 flows through a fluid line 52; and this fluid line includes parallel branches 52*a* and 52*b* within which branches are disposed respective pilot operated, two-way stop and start valves 53 and 54. The flow of fluid to the motor 43 is intermittent, as determined by the conditions of these pilot operated valves; and the conditions of these start and stop valves are controlled by operators including limit valves 55 and 56 and a cam operated stop pilot valve 57 operated by the rotary stop cam 48.

A variable orifice 60 is provided in the fluid line 52 to function as a speed control for the hydraulic motor 43.

The limit valves 55 and 56 are actuated by a cam 16 mounted on, or associated with, the cylinder rod 14; and the valve 55 is actuated by the cam when the rod approaches the limit of its extend stroke, while the valve 56 is actuated by the cam when the rod approaches the limit of its retract stroke. The stop pilot valve 57 is actuated by the lobes 49 of the stop cam and, as will be seen, effects the blocking of the fluid line 52 to stop the motor 43. Pressurized fluid is supplied to the limit valves from the pump 50 through branch lines 58, and to the pilot valve 57 through branch line 59. Pilot fluid is conducted from the limit valves to the start valve 54 through pilot line 61, consisting of branches 61*a*, 61*b* and 61*c*, and shuttle valve 62. Pilot fluid is conducted from the stop pilot valve 57 to the stop valve 53 through pilot line 65.

The stop valve 53 in branch line 52*a* is normally urged to the passing condition, wherein it passes fluid to the motor 43, and is shifted to the non-passing condition by pilot fluid from the pilot valve 57, when that valve is shifted by one of the lobes 49 of the stop cam 48. The pilot valve 57 is normally urged to the non-passing condition with respect to the flow of pilot fluid from the line 59 to the line 65 and the stop valve 53. In this non-passing condition, however, the pilot line 65 is opened to the tank 22 to allow the dumping of fluid in the line 65 and in the stop valve, thereby allowing the stop valve to shift to its normal passing condition. When the valve operator of the pilot valve 57 is engaged by one of the cam lobes 49, the valve is shifted to the passing condition passing pilot fluid to the stop valve to shift that valve to the non-passing condition.

The pilot operated start valve 54, in branch line 52*b*, is normally urged to the non-passing condition, and is shifted to the passing condition by pilot fluid from either one of the limit valves 55 and 56 conducted through pilot line 61. The limit valves 55 and 56 are identical and operate in an identical manner. Referring to the limit valve 55, this valve is normally urged to the non-passing condition, with respect to the flow of fluid from the fluid line 58 to the pilot line 61*a*. In this non-passing condition, however, the pilot line 61*a* is open to the tank 22 to allow dumping of some fluid in the pilot line 61 and thereby allowing the start valve 54 to shift to its non-passing condition. When the piston rod 14 approaches the limit of its extend stroke, the cam 16 shifts the limit valve 55 to the passing condition wherein pilot fluid is passed to the start valve to shift it to the passing condition. This pilot fluid flows through pilot line 61*a*, shuttle valve 62, and pilot line 61*c* to the start valve. The shuttle valve will respond to the pressure in line 61*a* to shift the valve and allow the indicated flow of fluid, since the line 61*b* is open to tank. Positive pressure will be maintained in pilot lines 61*a* and 61*c* to maintain the shuttle valve in that shifted condition, until that pressure is released. With the beginning of the retract stroke, the cam disengages from limit valve 55 allowing its return to its normal condition, relieving the pilot fluid pressure to allow the return of the start valve to its normal non-passing condition.

Similarly, when the cylinder rod 14 approaches the limit of its retraction stroke, the limit valve 56 is shifted to the passing condition to effect the shifting of the start valve to its passing condition through the pilot lines 61*b* and 61*c* and the shuttle valve 62*a*; and the start valve is returned to its non-passing condition in a similar manner.

The operation of the control system of FIG. 1 will now be described, beginning with the condition illustrated, namely that the piston rod 14 is moving in its extension stroke as indicated by the arrow. For this condition, the direction control valve 40 has been shifted to the left (its extend condition) wherein the line 41*b* is opened to the tank 22 and the line 41*a* is blocked at the direction control valve to effect the flow of fluid from the pump 20*a* to the cap end 12 of the cylinder 10. The direction control valve is held in that shifted condition by the crank arm 45 and the pitman arm 46; and the rotary hydraulic motor 43 is stopped to maintain that position of the crank arm 45 and also to maintain the stop cam 48 in the indicated position where one lobe 49 has shifted the stop pilot valve 57 to the passing condition. With this pilot valve 57 shifted to the passing condition, pilot fluid passes through the line 65 to the stop valve 53 thereby maintaining it in the non-passing condition. With the piston rod 14 in mid-stroke, both limit valves 55 and 56 are in the normal non-passing condition wherein the pilot lines 61*a*, 61*b* and 61*c* are all open to tank, and the start valve 54 is therefore urged to its normal non-passing condition. Both the stop and start valves, then, are in the non-passing condition to maintain the rotary motor 43 stopped with the stop cam 48 and crank 45 in the illustrated positions.

As the piston rod approaches its extend stroke limit, cam 16 shifts the limit valve 55 to the passing condition, whereby pilot fluid is passed through lines 61*a* and 61*c* and shuttle valve 62 to shift the start valve to its passing condition, thereby starting the rotary motor 43. This initates drive of the crank 45 and stop cam 48 through approximately 180 degrees to shift the spool of the direction control valve 40 from the extreme left position to the extreme right position. During this shifting the spool will first pass through a neutral or dump position wherein both lines 23*a* and 23*b* are open to tank 22. This shifting of the direction control valve first slows and stops the extend stroke, and then initiates the retract stroke of the piston rod.

With the initiation of the drive of the motor 43, the indicated cam lobe 49 moves off the actuator of pilot valve 57 allowing this valve to shift to its normal non-passing condition to block the fluid line 59 and also to open the pilot line 65 to tank thereby allowing the stop valve 53 to shift to its normal passing condition. Both the start and stop valves, then, are in the passing condition allowing continued drive of the motor 43.

When the movement of the direction control valve to the right reaches the point where it restricts the dump line 41*b* and effects the flow of fluid from the pump 20*b* through the line 23*b* to the rod end of the cylinder, the retract stroke begins and the cam 16 disengages the limit valve 55 allowing it to return to its normal non-passing condition, and this allows the start valve 54 to shift to its normal non-passing condition. Drive of the motor 43 continues since fluid is supplied through the stop valve 53.

When the crank arm 45 reaches a position 180 degrees from that illustrated and the direction control valve 40 is accordingly shifted fully to the right (its retract condition), the opposite cam lobe 49 shifts the stop pilot valve 57 to its passing condition to effect flow of pilot fluid to shift the stop valve to the non-passing condition and stop the motor 43. The motor 43 remains in that stopped condition until a similar reversing cycle is initiated by the shifting of the limit valve 56 by the piston rod cam 16 when it approaches the limit of the retract stroke.

The control system functions, then, to provide continuous control of the drive and reciprocation of the double-acting cylinder 10. It should be noted that if the pitman arm 46 were of infinite length, the valve spool of the direction control valve 40 would move in accordance with simple harmonic motion. With appropriate fixing of the length of the pitman arm and appropriate porting of the direction control valve, the system may be designed to effect acceleration and deceleration of the piston rod 14 in a pattern described by simple harmonic motion.

Figure 2:
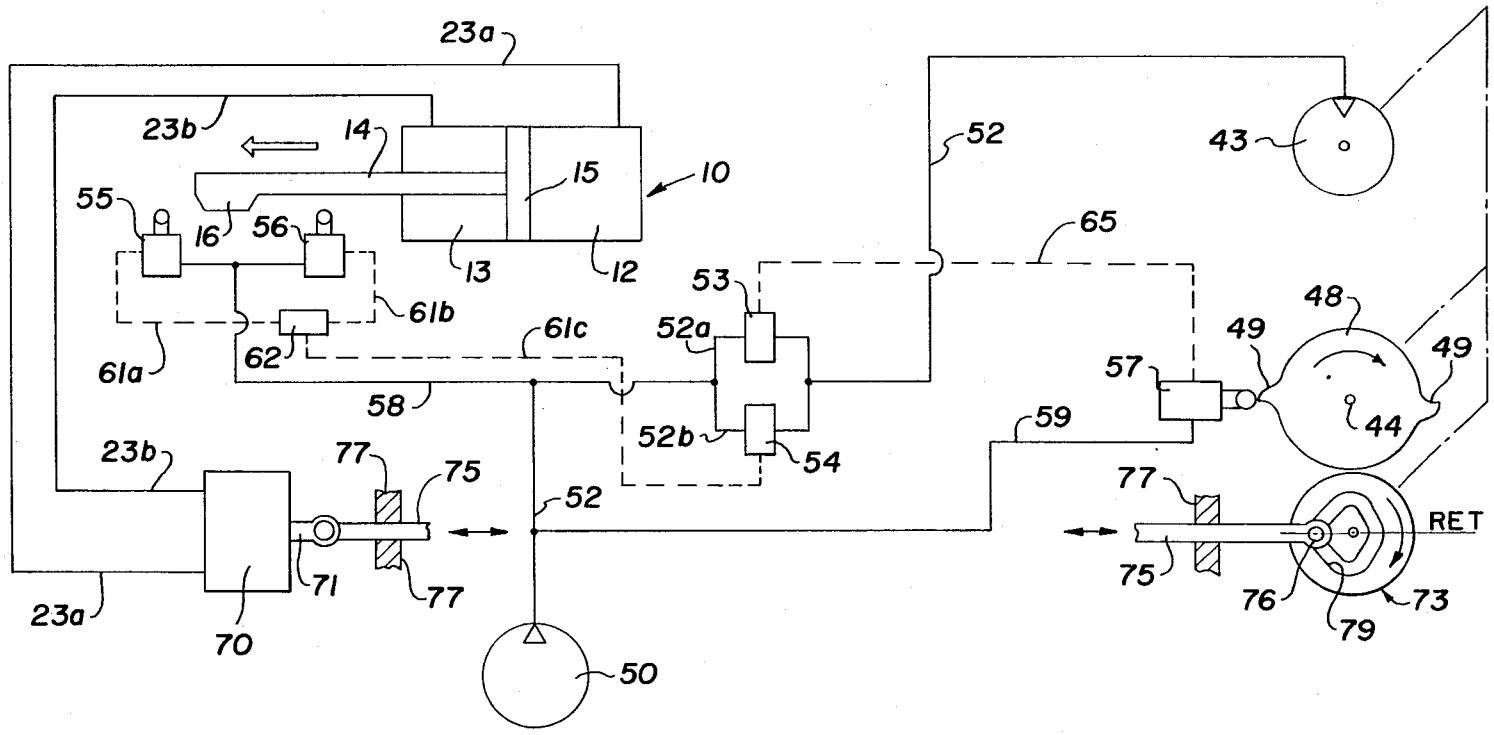
FIG. 2 is a schematic diagram of a double-acting power cylinder and an associated alternative control system embodying the invention.

Embodiment of FIG. 2

FIG. 2 illustrates, in broader schematic form, a doubleacting hydraulic cylinder and a system for controlling that cylinder, with the control system being quite similar to that of FIGS. 1A and 1B but with some variations. The components of this system which are identical to those of the system of FIG. 1 are identified by the same reference numbers.

In this system, a pump 70 for supplying hydraulic fluid alternately to the two ends of the cylinder 10 is a reversible variable volume pump, having a built in control for controlling both the output volume or displacement of the pump and also for controlling the direction of fluid flow and thereby functioning as a direction control. In the drawing an operator member 71 is associated with the pump direction control. A pump suitable for this purpose is the series PVP Pumps manufactured by the Double A Division of Brown and Sharp Manufacturing Company. This pump includes a rotatable cylinder block driven by the input shaft, the cylinder block containing nine piston assemblies disposed in axially parallel cylinder chambers, with the displacement of the piston assemblies being controlled by an oscillating cam plate. When the cam plate is disposed normal to the piston assemblies, the pump displacement is zero; and the reversal of the pump is accomplished by oscillating the cam plate in opposite directions from the zero displacement position. In the diagram of FIG. 2, the reciprocation of the operator 71 will control the oscillation of the cam plate.

The other variation in the system of FIG. 2 is that the rotary drive mechanism for the above described direction control is a rotary cam 73 in the form of a cam disk having a cam groove 74 in one face. A drive link 75 has a cam follower roller 76 at one end thereof for coaction with the cam groove 74; and the drive link 75 is guided for reciprocating movement in suitable bearings 77. The drive link 75 is coupled at its opposite end to the direction control operator 71.

The operation of this system is identical to that of the system of FIG. 1. In the condition illustrated in FIG. 2, the cam 73 and the link 75 have shifted the direction control 71 of the pump 20 to effect the extension of the piston rod 14 of the cylinder assembly 10. When the drive motor 43 is started, the cams 48 and 73 will be rotated 180 degrees, in the same manner as previously described, to effect the reversal of the pump direction control and effect the retract stroke of the cylinder 10.

EMBODIMENT OF FIGS. 3A AND 3B

In the operation of the system of FIGS. 1A and 1B, it is assumed that, once a reversing cycle of the motor 43 is initiated by the start valve 54, this start valve will be shifted back to its nonpassing condition prior to the completion of that motor cycle and the shifting of the stop valve 53 to its nonpassing condition. The applicant appreciates, however, that this desired timing sequence of the start and stop valves may not necessarily occur for some system designs where, for example, a limit valve 55 or 56 is necessarily engaged by the cam 16 for a substantial period of time.

Figure 3A:
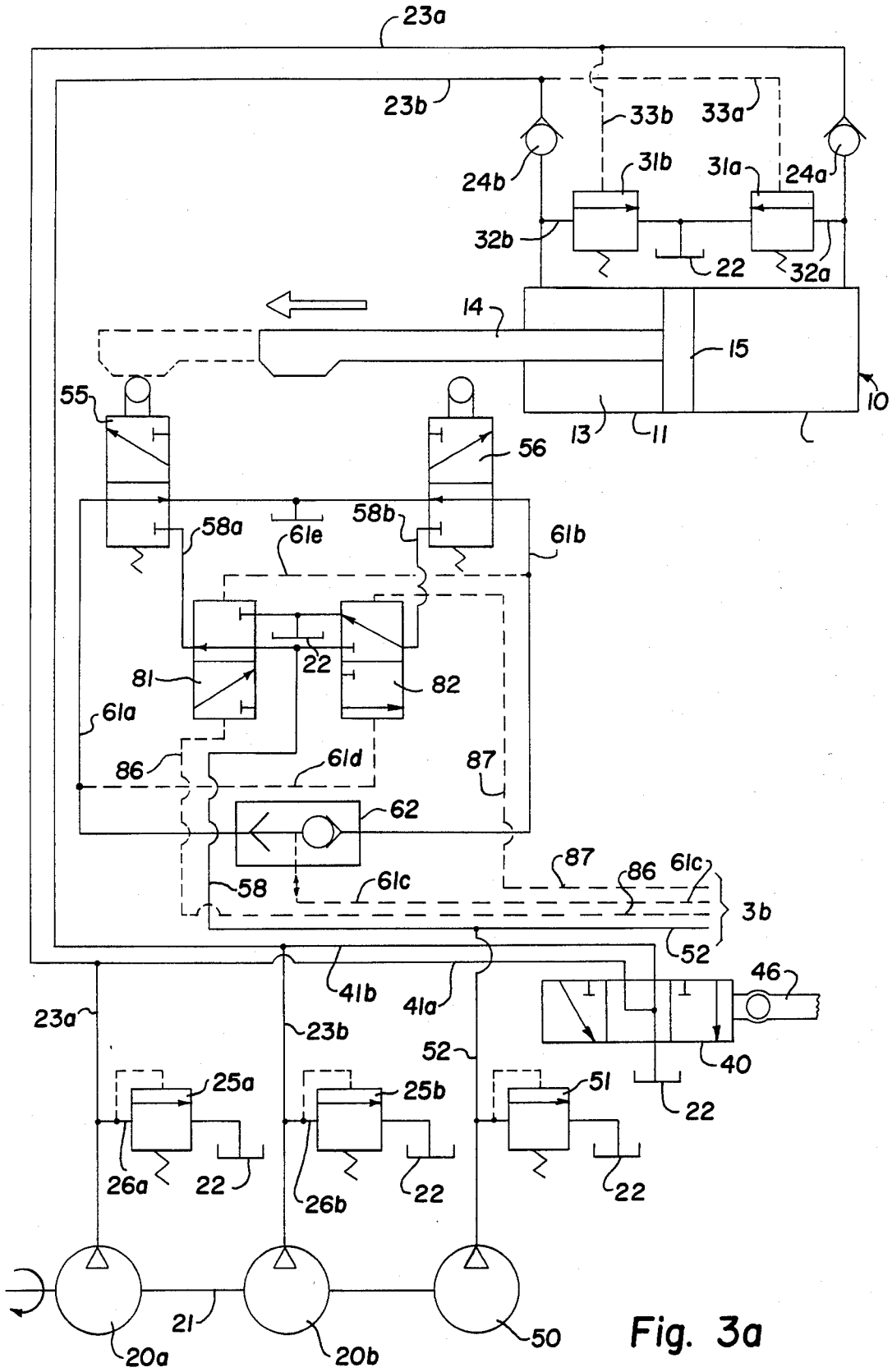
FIGS. 3A and 3B are a schematic diagram of a cylinder and system similar to that of FIG. 1, but including additional control components.
Figure 3B:
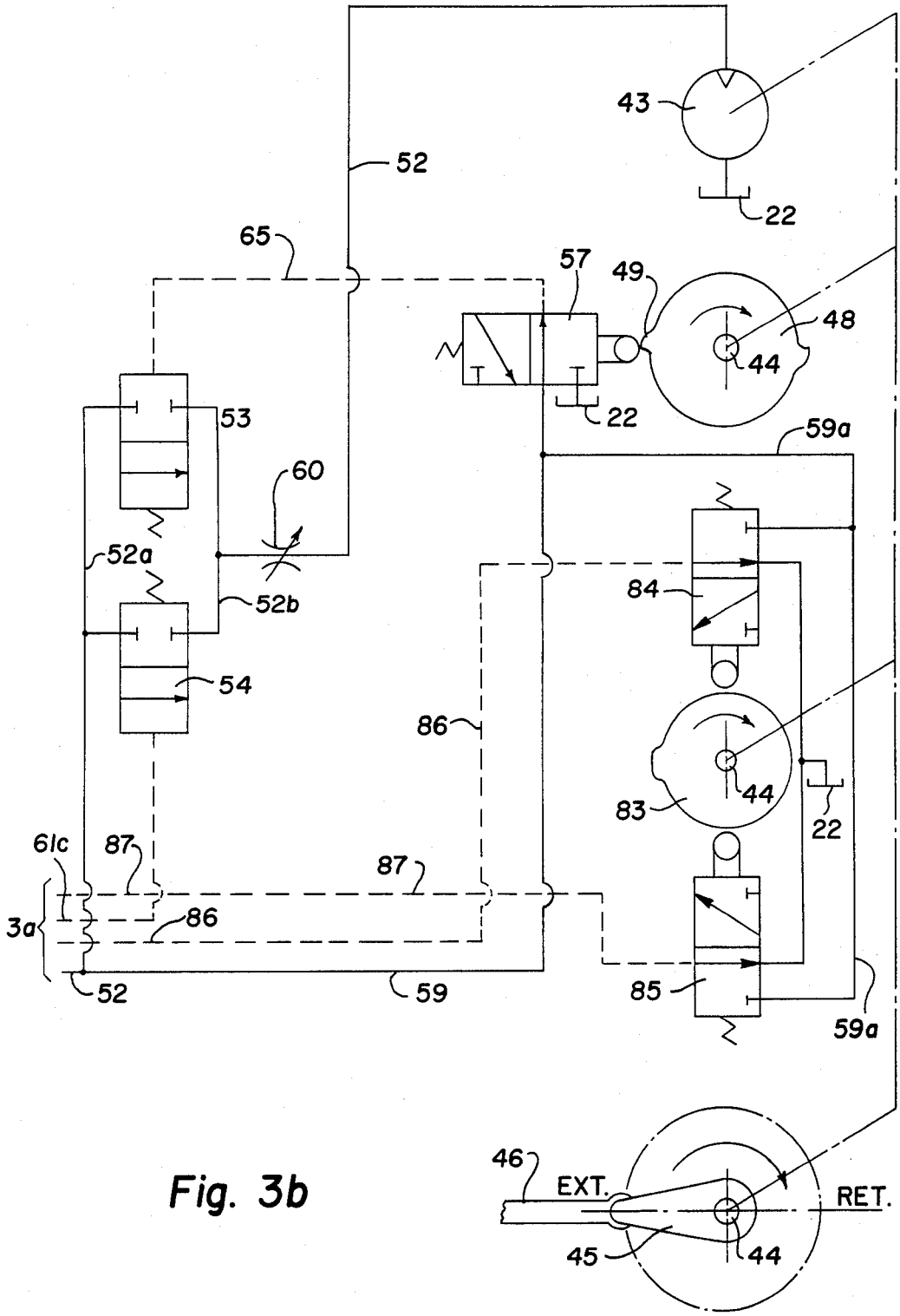

The system and logic circuit of FIGS. 3A and 3B is a modified form of the system and logic circuit of FIGS. 1A and 1B, and includes means to effect the shifting of the start valve 54 to its nonpassing condition shortly after the shifting of the stop valve to its passing condition, and independently of the piston rod cam 16. The system of FIGS. 3A and 3B includes all of the components of the previously described system, and some additional components which will now be described. The components and fluid lines which are common to the system of FIGS. 1A and 1B are identified by the same reference numbers.

Referring to FIG. 3A, fluid is supplied to the limit valves 55 and 56 from the pump 50 through the lines 52 and 58 and through dump valves 81 and 82 which are associated respectively with the limit valves 55 and 56. The dump valve 81 supplies fluid to its associated limit valve 55 through the branch line **58*a*; and the dump valve 82 supplies fluid to its associated limit valve 56 through the branch line 58*b*. These dump valves are bi-stable pilot operated valves which are shiftable by pilot fluid between closed and open conditions. In the open condition, these dump valves pass fluid from the line 58 to the respective branch lines 58*a* and 58*b* and associated limit valves 55 and 56. In the closed condition, these valves communicate the respective branch lines 58*a* and 58*b* with the tank 22** to allow dumping of the fluid from those branch lines.

The system effects the shifting of the dump valves to the open condition, to enable the passing of fluid by the associated limit valve when the limit valve is opened by the piston rod cam 16. Referring to FIG. 3A for example, with the piston rod moving in the indicated direction (to the left) the dump valve 81 has been shifted to the open condition, this shifting being accomplished when the cam 16 engaged the limit valve 56 to effect the flow of fluid through the line **61*b* to the shuttle valve 62. At this time pilot fluid passed through line 61*e* to shift the dump valve 81 to the open condition, so that that dump valve 81 is pre-conditioned to allow fluids to pass through the limit valve 55 when that valve is engaged by the cam 16 at the extend stroke limit. Similarly, at that point, the dump valve 82 is pre-conditioned by fluid passing through the line 61*d* to allow fluid to pass through the limit valve 56** at the retract stroke limit.

Referring now to FIG. 3B, the system and logic circuit for effecting the shifting of the dump valves to the closed-dump condition includes a rotary release cam 83 and associated cam operated release valves 84 and 85. The release cam 83 is nonrotatably mounted on the output shaft 44 of the motor 43 and driven in timed relation with the crank 45 and the stop cam 48.

The valves 84 and 85 are spring biased two-way valves normally urged to the closed condition, and shifted to the open condition when engaged by the operator lobe of the release cam 83. Pilot fluid is supplied to the release valves through the lines 52, 59 and branch lines **59*a*. The release valve 84 is associated with the dump valve 81 and supplies pilot fluid to the dump valve through the fluid line 86. Similarly, the release valve 85 is associated with the dump valve 82 and supplies pilot fluid to the dump valve through the fluid line 87**.

As best seen in FIG. 3B, the timing of the stop cam 48 and release cam 83 is such that when the drive of the motor 43 is initiated by the engagement of the limit valve 55 by the piston rod cam 16, for example, first the stop valve 53 is shifted to its open condition by the disengagement of the stop cam lobe 49 from the stop pilot valve 57, secondly the release valve 84 is shifted to its open condition by the release cam 83 to pass pilot fluid to the dump valve 81, and thirdly this necessarily occurs before the opposite lobe 49 of the stop cam re-engages the stop pilot valve 57. The passing of pilot fluid through the line 86 to the dump valve 81 shifts the dump valve to the closed-dump condition, allowing dumping of fluid from the line 58A to tank, thereby allowing the start valve 54 to shift to its normally closed condition. Accordingly the start valve 54 is closed even though the limit valve 55 is still engaged by the cam 16, so that the motor 43 is stopped when the opposite lobe of the stop cam 48 re-engages the stop pilot valve 57. The bi-stable dump valve 81 will remain in the closed-dump condition until it is pre-conditioned by the limit valve 56 at the retract stroke limit.

With the operation of the motor 43 initiated by the limit valve 56 at the retract stroke limit, a similar operating cycle occurs with the lobe of release cam 83 operating the release valve 85 to effect the flow of pilot fluid through the line 87 to the dump valve 82.

The operation of the system of FIGS. 3A and 3B will now be described briefly. With the piston rod 14 moving in its extend stroke, in the direction of the arrow, the dump valve 81 has been pre-conditioned to the open condition to supply fluid to the limit valve 55. When the pistoh rod approaches the limit of the extend stroke and engages the limit valve 55 pilot fluid is passed to the start valve 54 to shift that valve to the open condition and start the motor 43. Simultaneously pilot fluid is passed to the dump valve 82 through the line 61*d* to shift that valve to the open condition, and pre-condition that valve for a subsequent operation.

The motor 43 first disengages the stop cam lobe 49 from the stop pilot valve 57 to effect the shifting of the stop valve 53 to the open condition; and shortly thereafter engages the lobe of the release cam 83 with the release valve 84 to effect the shifting of the dump valve 81 to the closed-dump condition. This dumps fluid from the line 58*a* and the connected lines allowing the start valve 54 to return to its closed condition. The motor 43 continues to operate until the opposite stop cam lobe 49 engages the stop pilot valve 57 to effect the shifting of the stop valve 53 to its closed condition, thereby stopping motor 43.

At the end of the retract stroke a similar cycle occurs when the cam 16 engages the limit valve 56. First the start valve 54 is opened to start the motor 43, and simultaneously the dump valve 81 is pre-conditioned to the opened condition before a succeeding operation. Again, the motor 43 first disengages a stop cam lobe from the stop pilot valve 57, followed by the engagement of release valve 85 by the lobe of release cam 83. This effects the shifting of the dump valve 82 to the closed-dump condition to effect the closing of the start valve 54 even though the limit valve 56 is held open by the cam 16. When the cams 48 and 83 again reach the illustrated condition, the stop valve 53 is closed to stop the motor 43.

Method

A Method according to the invention includes some or all of the following steps, which steps may be performed by the systems described above:

Supplying pressurized fluid alternately to the opposing ends of a hydraulic cylinder by means having a direction control shiftable between extend and retract conditions.

Operating the direction control by means of a hydraulic motor and a coupled drive mechanism.

Controlling the supply of motive fluid to the hydraulic motor by means of parallel connected start and stop valves.

Controlling the start valve in response to the extend and retract movements of the hydraulic cylinder.

Controlling the stop valve in response to the shifting of the direction control.

Controlling the start valve by opening the valve in response to the approach of the hydraulic cylinder to the limit of either its extend or retract stroke, and by closing the valve in response to the operation of the hydraulic cylinder between the limits.

Controlling the stop valve by closing that valve in response to the direction control being shifted fully to either its extend or retract condition, and by opening that valve in response to the operation of the direction control between those extend and retract conditions.

Controlling the direction control and the stop valve by drive mechanisms coupled to each other in timed relation.

Operating the direction control and the stop valve control by a rotary hydraulic motor and coupled respective rotary drive mechanisms.

Opening the start valve in response to the approach of the hydraulic cylinder to the limit of either its extend or retract stroke; opening the stop valve in response to the operation of the direction control between its extend and retract conditions; closing the start valve in response to the opening of the stop valve; and closing the stop valve in response to the direction control being shifted fully to either its extend or retract condition.

What has been described is a unique simple and effective system and method for controlling the continuous reciprocation of a double-acting fluid power cylinder. A particular feature and advantage of the described system and method is that it includes a completely fluid controlled logic circuit.

Another particular feature and advantage of the system and method is that it provides a wide variety of control of the piston rod movements.

While preferred embodiments of the invention have been illustrated and described, it will be understood by those skilled in the art that changes and modifications may be resorted to without departing from the spirit and scope of the invention.

What is claimed is:

1. A system for controlling the reciprocation of and the acceleration and deceleration of the extend and retract strokes of a double-acting fluid cylinder having opposing power ends, comprising:

means connectable with a double-acting cylinder for supplying pressurized fluid alternately to opposite cylinder ends; said fluid supplying means including a direction control shiftable between extend and retract conditions to, respectively, extend and retract the rod of the cylinder;

drive means, including a rotary hydraulic fluid motor, connected with said direction control for shifting said direction control;

control means connected with said fluid motor for operating said fluid motor including: means including a speed control valve for supplying pressurized fluid to said motor; parallel connected start and stop valves connected between said fluid motor and said supplying means for controlling the passing of passing of fluid from said supplying means to said motor;

means responsive to the extend and retract strokes of the rod acting to open and start valve when the rod is at the limit of either its extend or retract stroke, and to close said start valve during the operation of said rod between said limits;

and stop valve operator means coupled with said motor for opening and closing said stop valve in timed relation with movement of said direction control, said stop valve operator means acting to close said stop valve when said direction control means is shifted to an extend or retract condition, and to open said valve during the shifting of said direction control between said conditions.

2. A system as set forth in claim 1 said start and stop valves each comprising a two-way pilot operated valve having pilot connections with said means responsive and stop valve operator means, respectively.

3. A system as set forth in claim 2 said start valve having spring means normally urging said valve to the closed condition;

said means responsive comprising limit valves actuated by said fluid cylinder at the limits of its extend and retract stroke; said limit valves acting to direct pilot fluid to said start valve to shift that valve to its open condition when said cylinder approaches the limit of either its extend or retract stroke.

4. A system as set forth in claim 2 said stop valve having spring means normally urging said valve to the open condition;

said operator means for said stop valve comprising a two-way cam operated valve, and a cam for operating said cam operated valve driven by said drive means in timed relation with said direction control; said cam operated valve acting to direct pilot fluid to close said stop valve when said direction control is shifted to an extend or retract condition.

5. A system as set forth in claim 1 including operator means for closing said start valve in timed relation to the opening of said stop valve.

6. A system as set forth in claim 5 said operator means for closing said start valve including means driven by said drive means in timed relation with said operator means for said stop valve.

7. A system as set forth in claim 6 said start valve comprising a pilot operated valve having spring means normally urging said valve to the closed condition;

said means responsive to the extend and retract strokes of the rod for opening said start valve comprising limit valves actuated by said fluid cylinder at the limits of its extend and retract stroke; said limit valves acting to direct pilot fluid to said start valve, to shift that valve to its open condition, when said cylinder is at the limit of either its extend or retract stroke;

said operator means for closing said start valve comprising pilot operated dump valves associated with said limit valves, cam driven pilot valves for supplying pilot fluid to said dump valves to shift said dump valves to the dump condition to effect the closing of said start valve, and cam means driven by said drive means, in timed relation with said operator means for said stop valve, for operating said pilot valves.

8. A method for controlling the reciprocation and the acceleration and deceleration of the extend and retract strokes of a double-acting fluid cylinder, comprising the steps:

supplying pressurized fluid alternately to the opposing ends of said cylinder by means having a direction control shiftable between extend and retract conditions;

shifting said direction control at a predetermined rate and pattern by means of a fluid motor and coupled drive means;

supplying motive fluid to said fluid motor through a speed control valve from parallel connected start and stop valves;

controlling said start valve in response to the extend and retract movements of said cylinder including opening said start valve in response to the approach of said fluid cylinder to the limit of either its extend or retract stroke, and closing said start valve in response to the operation of said fluid cylinder between said limits;

and controlling said stop valve in timed relation to the shifting of said direction control including closing said stop valve in response to said direction control being shifted fully to either its extend or retract conditions, and opening said stop valve in response to the operation of said direction control between said extend and retract conditions.

9. A method as set forth in claim 8, including the steps providing pilot operated valves as said start and stop valves;

controlling said pilot operated start valve by means of limit valves actuated by trip means associated with said fluid cylinder;

and controlling said pilot operated stop valve by means of a control valve and a control valve operator driven by said fluid motor; and driving said control valve operator in timed relation to the shifting of said direction control.

10. A method as set forth in claim 9, including the steps shifting said direction control by means of a unidirectional rotary fluid motor, and a rotary drive mechanism coupled to the output shaft of said motor;

controlling said stop valve by means of a cam operated control valve, and a rotary cam coupled to the output shaft of said motor.

11. A method as set forth in claim 8 including the step of controlling said stop valve by means of said rotary fluid motor and said coupled drive means comprise rotary drive mechanism.

12. A method as set forth in claim 11, including the step controlling the closing of said start valve by drive means coupled to said direction control drive means.

13. A method as set forth in claim 8, including the step of closing said start valve in timed relation to the opening of said stop valve.

* * * * *